US005553696A

United States Patent [19]

Burson, Jr.

[11] Patent Number: 5,553,696

[45] Date of Patent: Sep. 10, 1996

[54] SECURITY DEVICE FOR BILL CHANGERS

[76] Inventor: Benard Burson, Jr., 3000 Skylark Dr., Austin, Tex. 78757

[21] Appl. No.: 372,601

[22] Filed: Jan. 13, 1995

[51] Int. Cl.[6] ..... G07F 9/02; G07F 7/04

[52] U.S. Cl. ..... 194/201; 194/202; 194/203; 194/206; 221/21

[58] Field of Search ..... 194/200, 201, 194/202, 203, 206, 207, 240, 241, 216, 217, 218; 221/21

[56] References Cited

U.S. PATENT DOCUMENTS

| | | | |
|---|---|---|---|
| 3,768,616 | 10/1973 | Dykehouse et al. | 194/206 |
| 3,783,884 | 1/1974 | Carlberg | 194/206 |
| 4,470,496 | 9/1984 | Steiner | 194/206 X |
| 4,503,963 | 3/1985 | Steiner | 194/200 |
| 4,593,184 | 6/1986 | Bryce et al. | 194/206 X |
| 4,966,304 | 10/1990 | Kelly | 194/350 X |
| 5,113,990 | 5/1992 | Gabrius et al. | 194/206 |
| 5,316,117 | 5/1994 | Griner et al. | 194/203 |

FOREIGN PATENT DOCUMENTS

| | | | |
|---|---|---|---|
| 4139800 | 10/1979 | Japan | 194/206 |
| 4151100 | 11/1979 | Japan | 194/206 |
| 2253493 | 10/1990 | Japan | 221/21 |
| 5250546 | 9/1993 | Japan | 194/206 |
| 2062925 | 5/1981 | United Kingdom | 221/21 |

*Primary Examiner*—Karen B. Merritt
*Assistant Examiner*—Scott L. Lowe
*Attorney, Agent, or Firm*—Chase & Yakimo

[57] ABSTRACT

A security device for a bill changer that greatly reduces the risk of the coinage within the changer from being robbed. The security device includes a support having a bill insertion slot therethrough. The support is adapted to be securely attached to a front surface of a bill reader with the insertion slot aligned with a corresponding slot of the bill reader. A moveable blade is mounted on the support and detaches foreign objects extending from an inserted bill. An actuator member, preferably comprising two solenoids, is connected to the blade for moving the blade across the insertion slot in response to validation of an inserted bill by the bill reader to detach any foreign objects therefrom. Alternatively, the device may comprise an electrically responsive switch member adapted to be connected to the bill changer for disabling the changer and preventing the operation thereof, a timing member responsive to electrical pulses provided by the bill changer during delivery of the coinage and a control member interconnecting the timing member and the switching member for operating the switching member to disable the changer when the timing member assumes an alarm condition.

18 Claims, 4 Drawing Sheets

SECURITY DEVICE FOR BILL CHANGERS

FIELD OF THE INVENTION

This invention relates to a security device that is easily adaptable for use with many types of bill changer machines and that reduces or eliminates the risk of the coinage within a bill changer machine being robbed. More specifically, the device prevents robbers and vandals from stringing bill changers (i.e., attaching a pull-back tape or string to the trailing edge of a bill), which causes the changer mechanism to trip and dispense all of the coinage held therein.

BACKGROUND OF THE INVENTION

Devices that perform one or more tests on U.S. currency to determine their genuineness before dispensing change, commonly referred to as bill readers, are well known in the art. Typically in such devices, the paper currency being validated is moved over a path along which various optical, magnetic or edge-sensing tests are performed. On failing any of these tests, the bill is moved along the path in a reverse direction to be returned to the user, and no credit or change is given.

Such bill changers have become a target for vandals and robbers because they are subject to being tripped by stringing. Stringing occurs when a pull-back tape or string is attached to the trailing edge of a bill which is inserted into the bill acceptor portion of the bill changer for validation of the bill. Upon receiving change, the bill can be pulled back and reinserted again and again. Eventually, all of the change is emptied from the bill changer. Although certain methods and devices have been proposed to overcome this problem, such as the control circuit for a bill and coin changer disclosed in U.S. Pat. No. 4,503,963 to Steiner, these other devices are complicated and not easily adaptable to existing machines already in use.

SUMMARY OF THE INVENTION

Accordingly, it is a primary object of the subject invention to provide a security device that is easily adaptable for use with many types of existing bill changer machines.

It is a further object of the present invention to provide a security device for bill changer machines that includes a blade that moves across the bill insertion slot upon validation of the bill by the bill reader and detaches any foreign objects extending therefrom.

It is yet a further object of this invention to provide a security device for bill changer machines which is inexpensive relative to the cost of a replacement machine.

The foregoing objects are basically attained by providing a security device for bill changer machines. The device includes a support having a bill insertion slot therethrough. The support is adapted to be securely attached to the front surface of the machine's bill reader with the security device's insertion slot aligned with a corresponding slot of the bill reader. The device further includes a movable blade mounted on the support for detaching foreign objects, such as string or tape, extending from the trailing edge of an inserted bill. Two solenoids are connected to the blade member and move the blade member across the insertion slot in response to validation of an inserted bill by the bill reader to detach any foreign objects extending from the bill.

A second embodiment of the security device includes an electrically responsive switching member adapted to be connected with the bill changer for disabling the changer and preventing operation thereof, a timing member responsive to electrical pulses provided by the bill changer during delivery of coinage and a control member interconnecting the timing member and the switching member. The timing member has a normal condition indicative of delivery of proper coinage in exchange for an inserted bill and an alarm condition caused by an excessive number of received pulses indicative of an attempt to unlawfully remove coinage from the changer. The control member operates the switching member to disable the changer when the timing member assumes its alarm condition.

DETAILED DESCRIPTION

Figure 1:
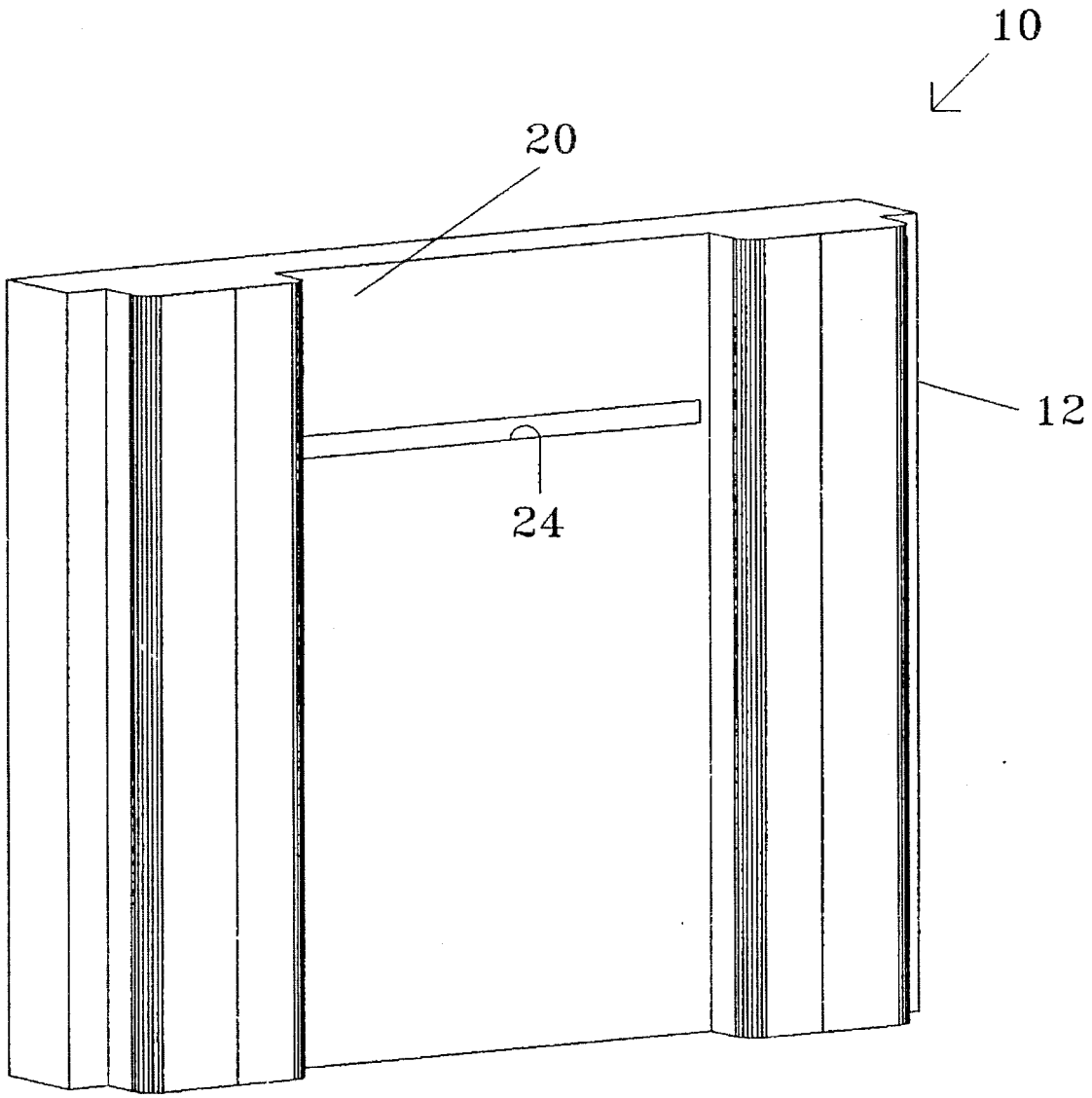
FIG. 1 is a front perspective view of the security device in accordance with the present invention.
Figure 2:
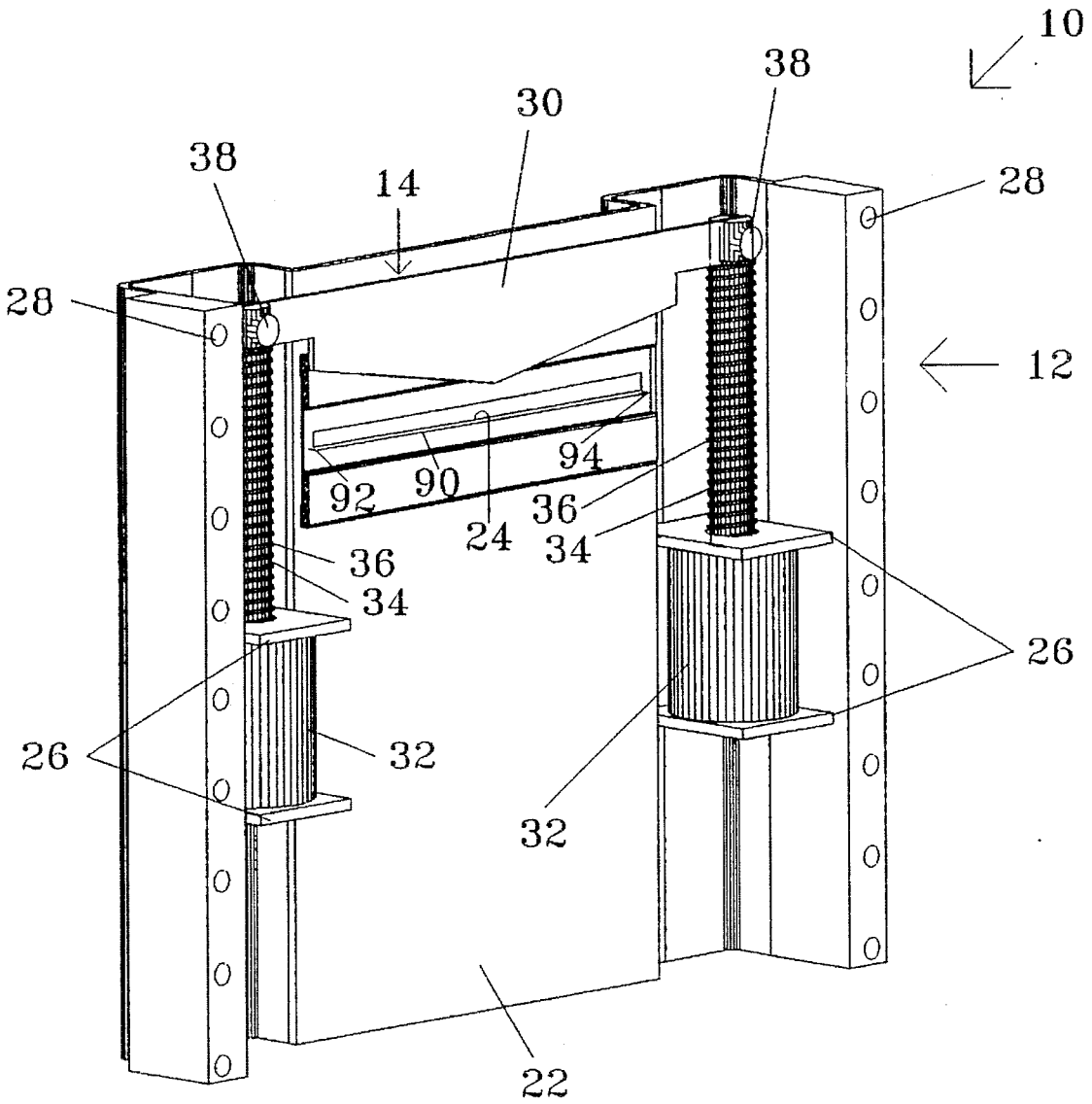
FIG. 2 is a rear perspective view of the security device in accordance with the present invention.
Figure 3:
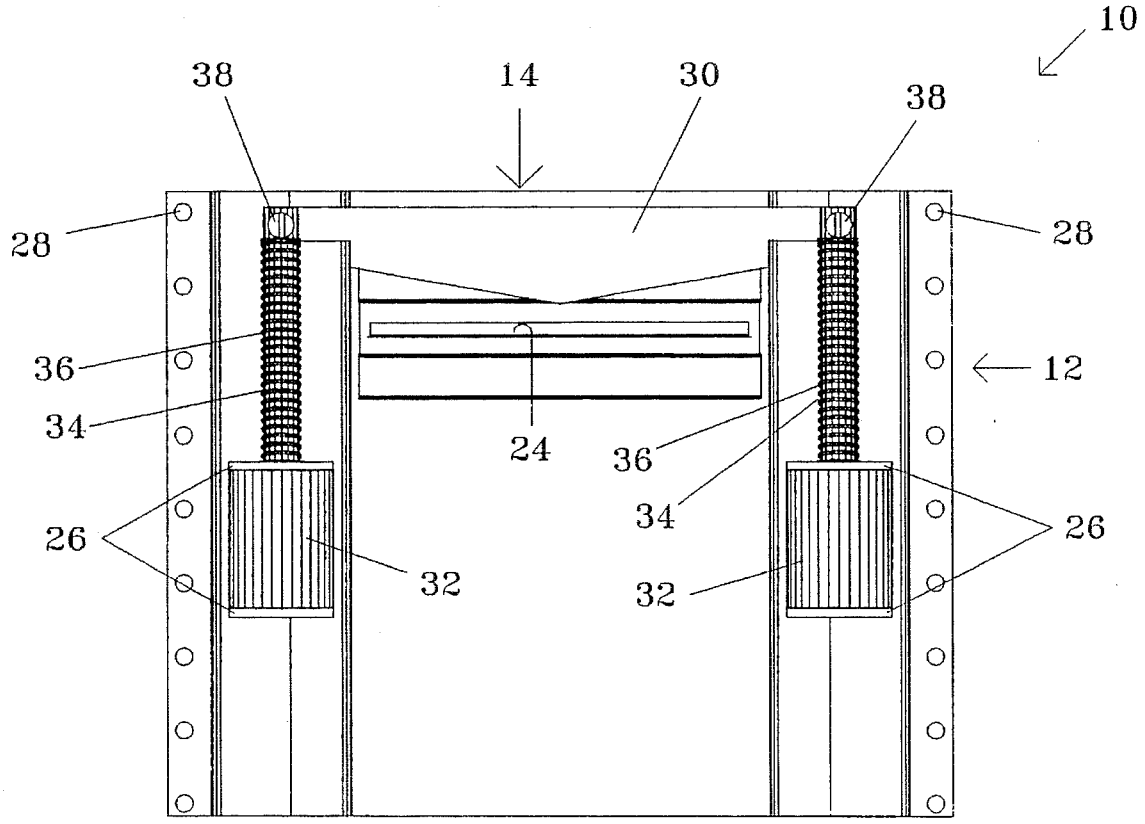
FIG. 3 is a rear elevational view of the security device of FIG. 2.

Security device 10 for bill changer machines, as seen in FIGS. 1–3, is easily adaptable for use with existing bill changers and includes a support 12, detaching or cutting member 14. Due to the action of detaching member 14, security device 10 prevents one from "stringing" a bill changer and thereby emptying the machine of the change held therein.

Support 12 is of metal construction and includes a panel presenting a front surface 20, a rear surface 22, bill insertion slot 24 in the panel and two mounting members 26. The sides of rear surface 22 of support 12 are mounted onto the front surface of a bill changing machine's bill reader (not shown) by inserting rivets, welds or screws through holes 28. Bill insertion slot 24 is rectangularly shaped and is substantially the same size as a bill reader's insertion slot. Support 12 is mounted so that bill insertion slot 24 is in alignment with the bill reader's slot. Bill insertion slot 24 is narrow enough so as to prevent the insertion of a user's fingers therein. Two spaced mounting members 26 extend from the rear surface 22 of support 12 and are aligned adjacent opposite sides of support 12, as seen in FIGS. 2 and 3. Each mounting member 26 presents two vertically spaced flanges which extend perpendicularly outwardly from the rear surface 22 of support 12. The upper flange of each mounting member 26 has a clearance opening through the center thereof.

Detaching or cutting member 14 includes a cutting blade 30, solenoids 32, plungers 34 and springs 36. Cutting member 14 is mounted on the rear surface 22 of support 12, as seen in FIGS. 2 and 3. Cutting blade 30 in its normal, rest position is mounted above bill insertion slot 24 and extends across the length thereof. The cutting blade 30 is preferably razor thin and has a triangular or wedge shaped cutting edge. Each solenoid 32 is fixedly mounted within a mounting member 26, as shown in FIGS. 2 and 3, and both solenoids 32 are operatively connected to the bill change machine's bill reader.

Each plunger or armature 34 extends from within the associated solenoid 32 and through the clearance opening in the upper flange of the corresponding mounting member 26.

The outer end of each plunger 34 receives an end of cutting blade 30 within a slot formed therein. A screw 38 inserted through the outer end of each plunger 34 and through cutting blade 30 fixedly attaches cutting blade 30 between plungers 34.

Springs 36 are preferably coil springs, as shown in FIGS. 2 and 3, and each spring 36 extends along and around a corresponding plunger 34 from the top surface of the upper flange of each mounting member 26 into engagement with the cutting blade 30. The normal biasing force of each spring 36 maintains the cutting blade 30 and plungers 34 in their normal rest position, with cutting blade 30 being located above bill insertion slot 24 as in FIGS. 2 and 3.

In operation, each time the bill reader machine validates a bill, the delivery solenoids (not shown) of the bill changer circuit are energized to deliver the proper coinage in exchange for the bill. Simultaneously with operation of the delivery solenoids, solenoids 32 are energized and cause plungers 34 to move downwardly against the bias of springs 36 a distance sufficient for the cutting blade 30 to pass over bill insertion slot 24. Cutting blade 30 thereby detaches any foreign objects, such as string or tape, from the trailing edge of the inserted bill. Upon deactivation of the solenoids 32, the bias of springs 36 returns plungers 34 and cutting blade 30 to their original rest position as seen in FIGS. 2 and 3.

Figure 4:
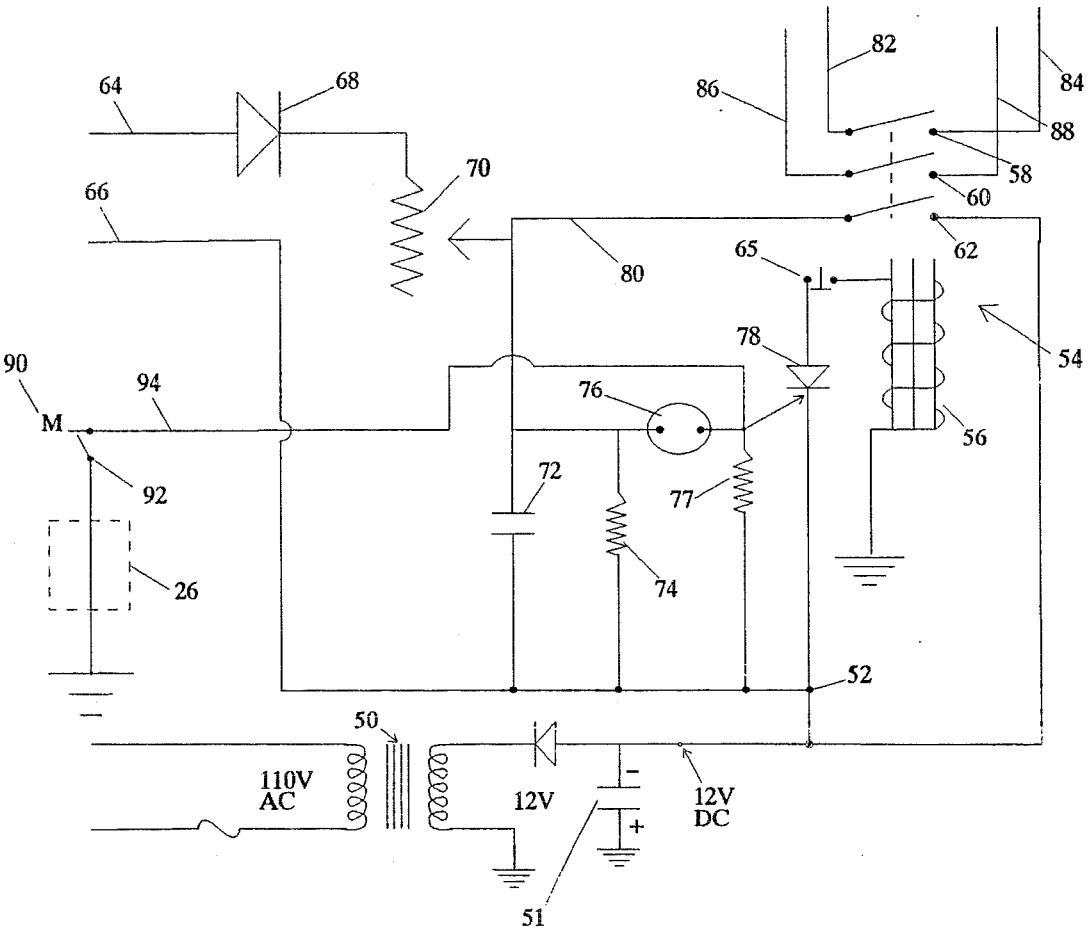
FIG. 4 is a circuit diagram of an alternative embodiment of the security device in accordance with the present invention.

An alternative embodiment of the present invention is shown in FIG. 4 and comprises a pulse-responsive security system for preventing a vandal from tripping the bill changer machine more than a few successive times, thereby preventing any substantial loss of the stored coinage. As indicated by power supply 50, a conventional 110 volt AC supply may be used to supply 12 volts DC to a relay 54 having a coil 56 and three sets of normally open contacts 58, 60 and 62. As will be discussed, closure of the relay contacts activates an alarm (not shown), removes all power to the coin changer machine, and resets a timing circuit.

A pair of input leads 64 and 66 are connected to the bill validator (not shown) that pulses the coin delivery solenoids of the bill changer. As alternating current is typically supplied, a diode 68 converts the input to direct current pulses which are applied to a variable resistor 70 in series with a capacitor 72. It may be appreciated, therefore, that the input pulses are applied directly across the series-connected resistor 70 and capacitor 72 as both input lead 66 and the bottom connection of capacitor 72 are at circuit negative bus. Accordingly, capacitor 72 will charge in response to the direct current pulses at a rate determined by the capacitance of capacitor 72 and the resistance of resistor 70, which may be adjusted as desired. The time constant of the charging circuit is further determined by a resistor 74 in parallel with capacitor 72. The voltage developed across capacitor 72 is applied via a neon glow lamp 76 (approximately 80 volts) to the gate of an SCR 78 having its cathode connected to circuit negative bus 52 and its anode connected to positive ground.

I provide the following parts list as one option of parts for use in my FIG. 4 circuitry.

D(68)=2 amp silicon diode 600 volts (ECG125)

$R_1$(70)=1 watt potentiometer Max 15000 ohms

CAP(72)=100 micro farads electrolytic capacitor 250 volts or more $R_2$(74)=bleed off resistor ½ watt 1 meg. ohm NE(76)=neon glow lamp (NE2)

$R_3$(77)=½ watt resistor approx. 3900 ohms

SCR(78)=silicon controlled rectifier>50 volts 1 amp $R_y$(56)=3 pole double throw 5 amp 5000 ohms relay T(50)=transformer 110 volt primary 12 volt primary 12 volt secondary approx. 2 amps $CAP_1$(51)=12 volt 1000 micro farad capacitor approx. 25 volts In normal use and operation of the bill changer, the pulses appearing on input leads 64 and 66 represent normal delivery of coinage in response to legitimate operation of the machine. Resistor 70 is adjusted such that these pulses do not charge capacitor 72 sufficiently to cause the neon lamp 76 to conduct. However, if a vandal attempts to trip the machine by stringing, the additional pulses appearing on leads 64–66 will charge the capacitor 72 to a voltage level that initiates conduction of the neon lamp 76 and triggers SCR 78. This energizes relay coil 56 to pull in contacts 58, 60 and 62.

Contacts 58 may be used to activate an alarm via leads 82 and 84, or activate a security camera or other device as desired. Contacts 60 are used to remove all power from the bill changer so that it is completely disabled, this being accomplished via control leads 86 and 88 to disable the power circuitry (not shown) of the changer. Closure of contact 62 immediately discharges capacitor 72 to negative bus via lead 80, so that there will be no residual charge on capacitor 72 at the beginning of the next pulse count. To reactivate the bill changer, the security system is reset by momentarily depressing a reset switch 65 to open the cathode-anode circuit of SCR 78 and release relay 54.

A moisture detector 90 is also provided to preclude a vandal from inserting a soaked bill into the machine in order to trip the machine and damage the reader device. In response thereto the moisture detector comprises a pad of blotting paper 92 surrounding the opening 24. One side of a wire lead 94 is connected to the junction of the neon lamp 76 and SCR 78. The other side is connected to the frame positive ground. When the paper becomes wet, the pad contacts the surrounding metal support. The grounded frame, as included in the FIG. 4 circuit causes a current flow thus causing the SCR 78 to conduct and close the circuit.

Although certain embodiments of this invention have been illustrated and described, my invention should not be limited thereto except as set forth in the following claims and allowable functional equivalents thereof.

Having thus described the invention, what is claimed as new and desired to be secured by Letters Patent is as follows:

1. A security device for use with a bill changer comprising:

electrically responsive switching means adapted to be connected with operating circuitry of the bill changer, said switching means having a first mode for disabling the operation of the circuitry, timing means responsive to electrical pulses provided by the circuitry in correspondence to delivery of coinage by the changer, said timing means having a normal condition upon receipt of a first rate of electrical pulses from the circuitry corresponding to a normal operation of the bill changer and an alarm condition caused by receipt of a second rate of electrical pulses from the circuitry caused by an abnormal operation of the changer, and control means for directing the switching means to said first mode when the timing means reaches said alarm condition.

2. A security device as claimed in claim 1 wherein said timing means comprises:

a capacitor charging in response to said pulses; and current conducting means associated with said capacitor for conducting a current to operate said control means upon said capacitor being charged by said second rate of electrical pulses.

3. A security device as claimed in claim 2 wherein said current conducting means comprises a neon lamp responsive to a selected charge on said capacitor.

4. A security device as claimed in claim 2 further comprising detecting means for detecting moisture on a bill inserted in the changer, said detecting means directing the switching means to said first mode.

5. A security device as claimed in claim 2 wherein said control means includes a silicon controlled rectifier responsive to said current.

6. A security device as claimed in claim 5 wherein said control means further comprises a relay responsive to said silicon controlled rectifier, said relay providing a response to said switching means.

7. A security device as claimed in claim 6 wherein said switching means further operates a detection device.

8. A security device as claimed in claim 7 wherein said detection device is a camera.

9. A security device as claimed in claim 7 wherein said detection device is an alarm.

10. A security device for use with a bill changer comprising:

electrically responsive switching means adapted to be connected with operating circuitry of the bill changer, said switching means having a mode for disabling the operation of the circuitry, timing means responsive to electrical pulses provided by the circuitry in correspondence to an abnormal delivery of coinage by the changer, said timing means having an alarm condition caused by receipt of said electrical pulses caused by said abnormal coinage delivery, and control means for directing the switching means to said disabling mode when the timing means reaches said alarm condition.

11. A security device as claimed in claim 10 wherein said timing means comprises:

a capacitor charging in response to said pulses; and current conducting means associated with said capacitor for conducting a current to operate said control means upon said capacitor being charged by said pulses caused by said abnormal coinage delivery.

12. A security device as claimed in claim 11 wherein said current conducting means comprises a neon lamp responsive to a selected charge on said capacitor.

13. A security device as claimed in claim 11 further comprising detecting means for detecting moisture on a bill inserted in the changer, said detecting means directing the switching means to said disabling mode.

14. A security device as claimed in claim 11 wherein said control means includes a silicon controlled rectifier responsive to said current.

15. A security device as claimed in claim 14 wherein said control means further comprises a relay responsive to said silicon controlled rectifier, said relay providing a response to said switching means.

16. A security device as claimed in claim 15 wherein said switching means further operates a detection device.

17. A security device as claimed in claim 16 wherein said detection device is a camera.

18. A security device as claimed in claim 16 wherein said detection device is an alarm.

* * * * *